US008813855B2

(12) United States Patent
Lake

(10) Patent No.: US 8,813,855 B2
(45) Date of Patent: Aug. 26, 2014

(54) STACKABLE MULTI-BARRIER SYSTEM AND METHOD

(75) Inventor: Gary B. Lake, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 476 days.

(21) Appl. No.: 12/961,954

(22) Filed: Dec. 7, 2010

(65) Prior Publication Data

US 2012/0138309 A1 Jun. 7, 2012

(51) Int. Cl.
*E21B 34/06* (2006.01)
*E21B 43/14* (2006.01)

(52) U.S. Cl.
CPC ..... *E21B 43/14* (2013.01); *E21B 34/06* (2013.01)
USPC ..... 166/373; 166/380; 166/381; 166/322

(58) Field of Classification Search
USPC ..... 166/373, 377, 378, 380, 381, 322, 316
See application file for complete search history.

(56) References Cited

U.S. PATENT DOCUMENTS

| | | | | |
|---|---|---|---|---|
| 5,372,193 | A | 12/1994 | French | |
| 5,465,787 | A | 11/1995 | Roth | |
| 5,831,156 | A | 11/1998 | Mullins | |
| 5,875,852 | A | 3/1999 | Floyd et al. | |
| 6,302,216 | B1 | 10/2001 | Patel | |
| 6,491,102 | B2 | 12/2002 | Leismer et al. | |
| 6,598,675 | B2 | 7/2003 | Bussear et al. | |
| 6,675,893 | B2 | 1/2004 | Lund | |
| 6,695,049 | B2 | 2/2004 | Ostocke et al. | |
| 7,152,688 | B2 | 12/2006 | Richards | |
| 7,219,743 | B2 | 5/2007 | Wolters et al. | |
| 7,228,914 | B2 | 6/2007 | Chavers et al. | |
| 7,322,422 | B2 | 1/2008 | Patel | |
| 7,428,924 | B2 | 9/2008 | Patel | |
| 7,430,153 | B2 | 9/2008 | Fraser et al. | |
| 7,487,830 | B2 | 2/2009 | Wolters et al. | |
| 7,617,876 | B2 | 11/2009 | Patel et al. | |
| 7,640,977 | B2 | 1/2010 | Jonas | |
| 8,056,628 | B2 | 11/2011 | Whitsitt et al. | |
| 8,286,713 | B2 | 10/2012 | Broussard | |
| 2003/0150622 | A1* | 8/2003 | Patel et al. | 166/373 |
| 2003/0211768 | A1 | 11/2003 | Cameron et al. | |
| 2004/0159444 | A1 | 8/2004 | Wolters et al. | |
| 2005/0092501 | A1 | 5/2005 | Chavers et al. | |
| 2005/0126789 | A1* | 6/2005 | Nivens et al. | 166/357 |

(Continued)

FOREIGN PATENT DOCUMENTS

WO 2011005826 A1 1/2011

OTHER PUBLICATIONS

Martin P. Coronado et al., "Advanced Openhole Completions Utilizing a Simplified Zone Isolation System"; Socity of Petroleum Engineers, SPE Paper No. 77438; Sep. 29, 2002.

(Continued)

*Primary Examiner* — Brad Harcourt
(74) *Attorney, Agent, or Firm* — Cantor Colburn LLP

(57) ABSTRACT

A multi-barrier system includes a first valve in fluid communication with a lower completion, and a second valve in fluid communication with the lower completion. The first valve and the second valve are positioned proximate an uphole extent of the lower completion, and a packer located proximate the first valve and the second valve is closable in response to retrieving an upper completion.

11 Claims, 3 Drawing Sheets

(56) References Cited

U.S. PATENT DOCUMENTS

| | | | | |
|---|---|---|---|---|
| 2006/0151183 | A1 | 7/2006 | Turner | |
| 2007/0084607 | A1* | 4/2007 | Wright et al. | 166/373 |
| 2007/0227727 | A1 | 10/2007 | Patel et al. | |
| 2007/0235185 | A1 | 10/2007 | Patel et al. | |
| 2007/0295504 | A1 | 12/2007 | Patel et al. | |
| 2008/0223585 | A1 | 9/2008 | Patel et al. | |
| 2009/0025923 | A1 | 1/2009 | Patel et al. | |
| 2009/0078429 | A1 | 3/2009 | Du et al. | |
| 2010/0206579 | A1 | 8/2010 | Guven et al. | |
| 2010/0300702 | A1* | 12/2010 | Andrews et al. | 166/373 |
| 2011/0192596 | A1 | 8/2011 | Patel | |
| 2012/0138309 | A1 | 6/2012 | Lake | |

OTHER PUBLICATIONS

L. Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

Notification of Transmittal of the International Search Report and the Written Opinion of the International Searching Authority; PCT/US2011/063519; Mailed Jul. 30, 2012; Korean Intellecutal Property Office; 8 pages.

K. Munday et al., "Want to Make Tree Operations Safer? Why Not Use the DHSV as a Barrier?"; Society of Petroleum Engineers, SPE Paper No. 96337; Sep. 24, 2006.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010.

Notification of Transmittal of the International Search Report and the Written Opinion of the International Searching Authority; PCT/US2011/060168; Mailed Jun. 29, 2012; Korean Intellectual Property Office; 10 pages.

Notification of Transmittal of the International Search Report and the Written Opinion of the International Searching Authority; PCT/US2013/026856; Mailed May 30, 2013; Korean Intellecutal Property Office; 14 pages.

Great Britain Search Report for GB Application No. 1303095.2, dated Jun. 24, 2013, pp. 1-5.

* cited by examiner

STACKABLE MULTI-BARRIER SYSTEM AND METHOD

BACKGROUND

In the downhole drilling and completion industry, there is often need to contain fluid within a formation during various operations. Conventionally, a mechanical barrier is put in the system that can be closed to contain the formation fluid when necessary. One example of a system known in the art will use a valve in operable communication with an Electric Submersible Pump (ESP) so that if/when the ESP is pulled from the downhole environment, formation fluids will be contained by the valve. While such systems are successfully used and have been for decades, in an age of increasing oversight and fail safe/failure tolerant requirements, additional systems will be well received by the art.

SUMMARY

Disclosed herein is a multi-barrier system including a first valve in fluid communication with a lower completion, and a second valve in fluid communication with the lower completion. The first valve and the second valve are positioned proximate an uphole extent of the lower completion, and a packer located proximate the first valve and the second valve is closable in response to retrieving an upper completion.

Also disclosed herein is a method of redundantly closing a wellbore nonpermanently upon retrieval of an upper completion, including disengaging an upper completion from a lower completion, closing a first valve in response to the disengaging, closing a second valve in response to the disengaging, reengaging an upper completion with the lower completion, opening the first valve, and opening the second valve.

BRIEF DESCRIPTION OF THE DRAWINGS

Referring now to the drawings wherein like elements are numbered alike in the several Figures.

DETAILED DESCRIPTION

Figure 1:
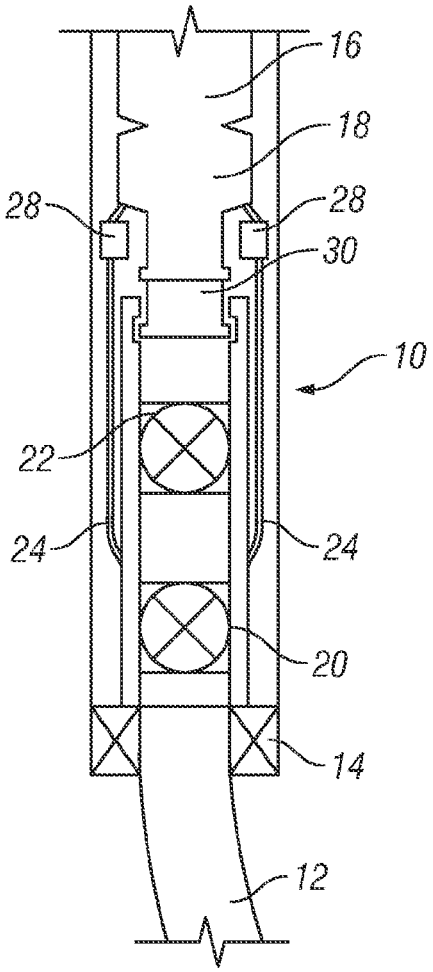
FIG. 1 is a schematic view of a stackable multi-barrier system.

Referring to FIG. 1, a stackable multi-barrier system 10 is illustrated. Illustrated is a portion of a lower completion 12, a packer 14 and a portion of an upper completion 16. One of ordinary skill in the art will be familiar with the lower completion 12 and the packer 14 and the concept of an upper completion 16 in operable communication therewith. In the illustrated embodiment an electric submersible pump (ESP) 18 is included in the upper completion 16, which is a device well known to the art. Between the illustrated ESP 18 and the lower completion 12 however, one of ordinary skill in the art will be surprised to see a number of mechanical barriers 20, 22 (sometimes referred to herein as "valves") that is greater than one. As illustrated in the figures hereof there are two but nothing in this disclosure should be construed as limiting the number of mechanical barriers to two. Rather more could also be added, if desired.

In one embodiment the more downhole valve 20 is a hydraulically actuated valve such as an ORBIT™ valve available commercially from Baker Hughes Incorporated, Houston Tex. and the more uphole valve 22 is a mechanically actuated valve such as a HALO™ valve available from the same source. It will be appreciated that these particular valves are merely exemplary and may be substituted for by other valves without departing from the invention.

Control lines 24 are provided to the valve 20 for hydraulic operation thereof. In the illustrated embodiment the lines also have a releasable control line device 28 in line therewith to allow for retrieval of the upper completion 16 apart from the lower completion 12. Also included in this embodiment of the system 10 is a stroker 30 that may be a hydraulic stroker in some iterations.

The components described function together to manage flow between the lower completion 12 and the upper completion 16. This is accomplished in that the valve 20 is settable to an open or closed position (and may be variable in some iterations) based upon hydraulic fluid pressure in the control line 24. The valve 22 is opened or closed based upon mechanical input generated by movement of the upper completion 16, or in the case of the illustration in FIG. 1, based upon mechanical movement caused by the stroker 30 that is itself powered by hydraulic fluid pressure. Of course, the stroker 30 could be electrically driven or otherwise in other embodiments. In any condition, the valve 22 is configured to close upon withdrawal of the upper completion 16. In normal production, both of the valves 20 and 22 will remain open unless there is a reason to close them. Such a reason occurs, for example, when it is required to retrieve the upper completion 16 for some reason. One such reason is to replace the ESP 18. Regardless of the reason for closure, employment of the system 10 in a completion string provides more than one mechanical barrier 20, 22 at an uphole extent of the lower completion 12. The barriers when closed prevent fluid flow after the upper completion is retrieved.

Figure 2:
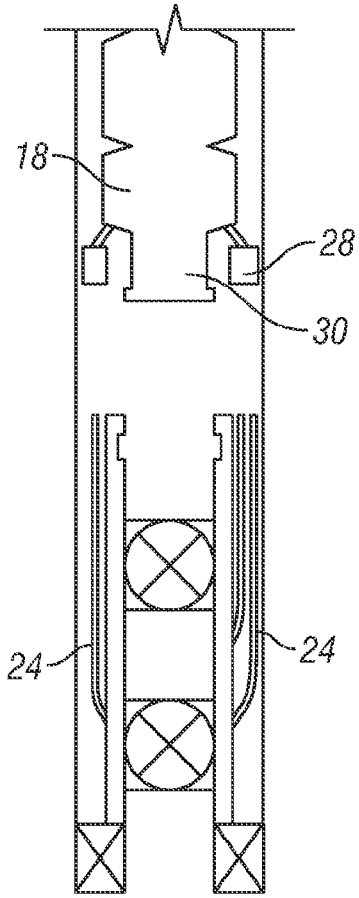
FIG. 2 is a schematic view of the system of FIG. 1 in partial withdrawal from the borehole.

Attention is directed to releasable control line devices 28 and FIG. 2. During a withdrawal of the upper completion 16, the control lines 24 are subjected to a tensile load. The releasable control line devices will release at a threshold tensile load and seal the portion of the control lines 24 that will remain in the downhole environment as a part of the lower completion string 12. The valve 20, if not already closed, is configured to close in response to this release of the control lines 24. This will complete the separation of the upper completion 16 from the lower completion 12 and allow retrieval of the upper completion 16 to the surface. With more than one mechanical barrier 20, 22 in place at the uphole extent of the lower completion 12, there is improved confidence that fluids will not escape from the lower completion 12. Important to note here briefly is that the system 10 also includes provision 44 for allowing the reopening of the valve 20 using tubing pressure after the upper completion 16 is reinstalled. This will be addressed further hereunder.

Figure 3:
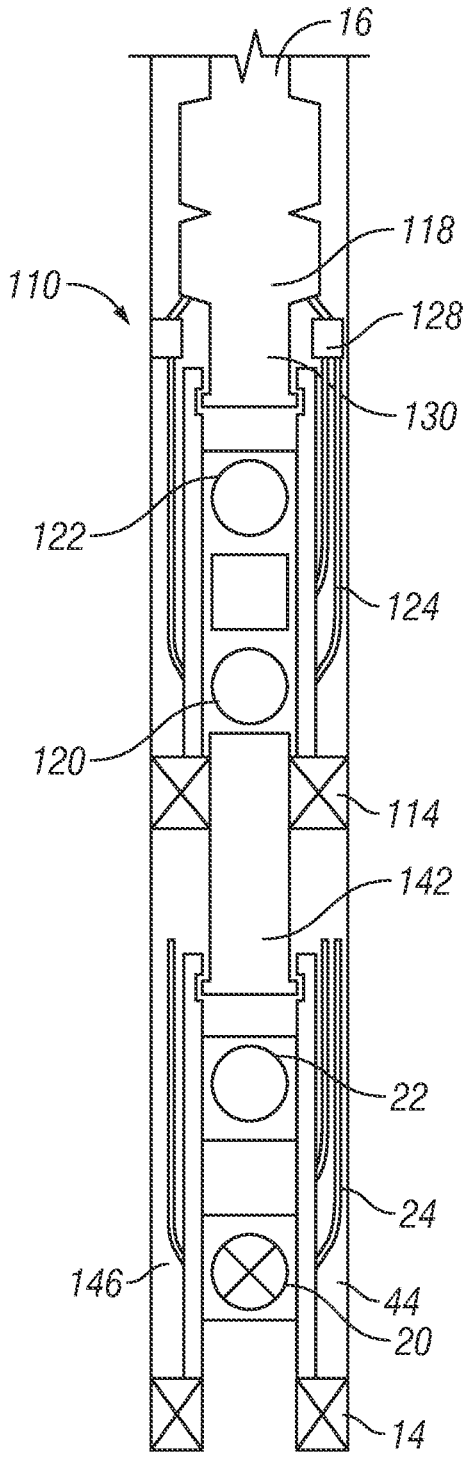
FIG. 3 is a schematic view of a new stackable multi-barrier system engaged with the remains of the system illustrated in FIG. 1.

In order to restore production, another system 110 is attached at a downhole end of upper completion 16 and run in the hole. This is illustrated in FIG. 3. The original system 10 has components such as packer 14, valves 20 and 22 and control lines 24 are seen at the bottom of the drawing and a new system 110 stackable on the last is shown. The new system 110 includes a packer 114 valve 120, valve 122, lines 124, stroker 13, ESP 118 and releasable hydraulic line device 128. In essence each of the components of system 10 is duplicated in system 110. Moreover, it should be understood that the process of pulling out and stabbing in with new systems can go on ad infinitum (or at least until practicality dictates otherwise).

Figure 4:
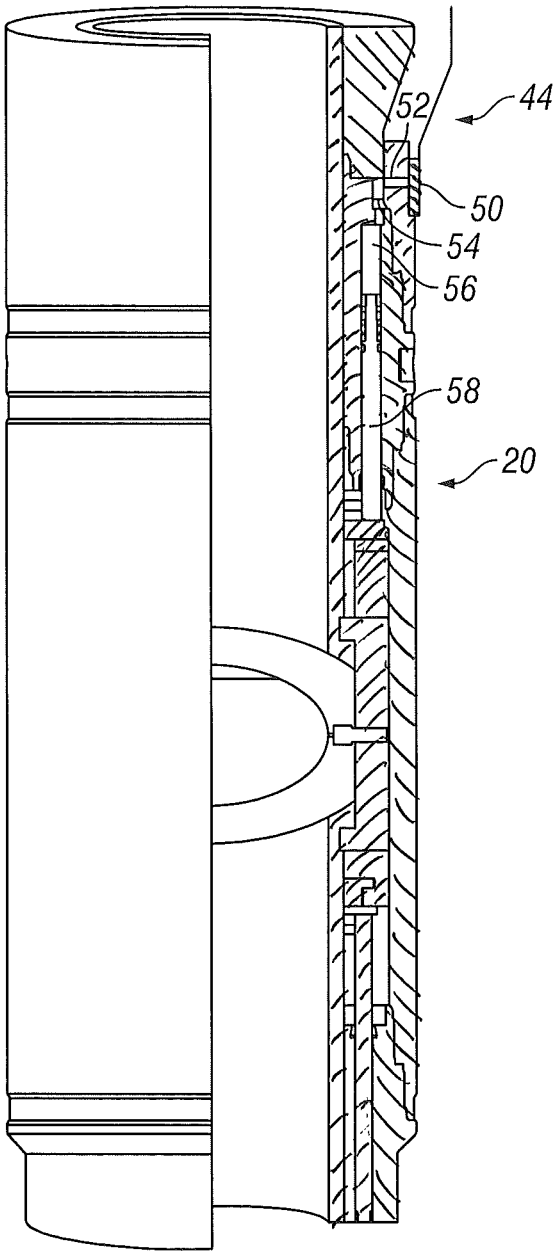
FIG. 4 depicts a quarter cross sectional view of a portion of a hydraulically actuated valve employed in the stackable multi-barrier system of FIGS. 1-3.

Since the valves 20 and 22 will be in the closed position, having been intentionally closed upon preparing to retrieve the upper completion 16, they will need to be opened upon installation of the new system 110. This is accomplished by stabbing a mechanical shiftdown 142 into valve 22 and setting packer 114. The mechanical shiftdown 142 mechanically shifts the valve 22 to the open position. It should be pointed out that, in this embodiment, the mechanical shiftdown 142 does not seal to the valve 22 and as such the inside of the upper completion 16 is in fluidic communication with annular space 146 defined between the packers 14 and 114. Applying pressure to the tubing at this point will result in a pressure buildup that will act on the valve 20 through the string uphole thereof since all valves thereabove, 22, 120 and 122 are in the open position. Referring to FIG. 4, a view of valve 20 illustrates the provision 44 that includes a port 52 in operable communication with an optional shifter 50. The shifter 50 is configured to open the port 52 in response to retrieval of the upper completion 16. As illustrated the shifter 50 in this embodiment is a sleeve that is automatically actuated upon retrieval of the upper completion 16. More specifically, when upper completion 16 begins to move uphole, the provision 44 is shifted to the open position. When the provision 44 is in the open position tubular fluid pressure is in communication with the port 52. The port 52 includes an openable member 54 such as a burst disk or similar that when opened provides fluid access to an atmospheric chamber 56. The member 54 opens upon increased tubing pressure and allows fluid to fill the atmospheric chamber 56. Fluid in the atmospheric chamber causes one or more pistons 58 to urge the valve 20 to the open position. In one embodiment, ratcheting devices (not shown) may be provided in operable communication with the one or more pistons 58 to prevent the pistons from moving in a direction to allow the valve to close by serendipity at some later time. It may also be that the valve 20 itself is configured to be locked permanently open by other means if the atmospheric chamber floods.

The foregoing apparatus and method for its use allows for the retrieval and replacement of an upper completion without the need for a wet connection.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A multi-barrier system comprising:

a first valve in fluid communication with a lower completion;

a second valve in fluid communication with the lower completion, the first valve and the second valve being positioned proximate an uphole extent of the lower completion; and a packer located proximate the first valve and the second valve, the valves being closable in response to retrieving an upper completion to redundantly prevent flow from the lower completion while the upper completion is disengaged from the lower completion the second valve being reopenable subsequent reengagement of a second upper completion with the lower completion.

2. The multi-barrier system of claim 1, wherein the first valve is closable in response to disconnection of a control line connected thereto.

3. The multi-barrier system of claim 1, wherein the second valve is mechanically closed upon withdrawal of the upper completion.

4. The multi-barrier system of claim 1, wherein the first valve is locked open upon reopening subsequent reengagement of a second upper completion.

5. The multi-barrier system of claim 1, wherein the first valve is reopenable upon pressuring up through a second upper completion reengaged with the lower completion.

6. The multi-barrier system of claim 1, wherein release of a release member is needed before the first valve can be reopened.

7. The multi-barrier system of claim 6, wherein the release member is a rupture disc.

8. A multi-barrier system comprising:

a first valve in fluid communication with a lower completion;

a second valve in fluid communication with the lower completion, the first valve and the second valve being positioned proximate an uphole extent of the lower completion;

a packer located proximate the first valve and the second valve, the valves being closable in response to retrieving an upper completion to redundantly prevent flow from the lower completion while the upper completion is disengaged from the lower completion;

a second upper completion engagable with the lower completion after retrieval of a first upper completion, the second upper completion comprising:

a third valve in fluid communication with the second upper completion;

a fourth valve in fluid communication with the second upper completion, the third valve and the fourth valve being positioned proximate an uphole extent of the second upper completion; and a packer located proximate the third valve and the fourth valve, the third valve and fourth valve being closable in response to retrieving an additional upper completion from the second upper completion to redundantly prevent flow from the second upper completion while the additional upper completion is disengaged from the second upper completion.

9. A method of redundantly closing a wellbore nonpermanently upon retrieval of an upper completion, comprising:

disengaging an upper completion from a lower completion;

closing flow from the lower completion with a first valve via a first mechanism in response to the disengaging;

closing flow from the lower completion with a second valve in response to the disengaging;

reengaging an upper completion with the lower completion;

pressuring up the upper completion;

actuating a second mechanism;

opening the first valve via the second mechanism; and opening the second valve.

10. The method of redundantly closing a wellbore nonpermanently upon retrieval of an upper completion of claim 9, wherein the closing of the first valve is in response to disconnection of at least one control line.

11. The method of redundantly closing a wellbore nonpermanently upon retrieval of an upper completion of claim 9, further comprising locking the first valve in an open position.

* * * * *